US007585454B2

(12) United States Patent
Noga et al.

(10) Patent No.: US 7,585,454 B2
(45) Date of Patent: Sep. 8, 2009

(54) PROCESS OF AND APPARATUS FOR MAKING AN INSULATION PRODUCT

(75) Inventors: Michael J. Noga, Oakville (CA); David Warren Arseneau, Burlington (CA); John D. Ireland, Burlington (CA); William Malcolm Worden, Oakville (CA); Zhiyong Fu, Hamilton (CA); Reginald A. Cooke, Burlington (CA); Martin H. Beck, Amherst, NH (US)

(73) Assignee: RTICA, Inc., Haliburton, ON (CA)

( * ) Notice: Subject to any disclaimer, the term of this patent is extended or adjusted under 35 U.S.C. 154(b) by 831 days.

(21) Appl. No.: 10/490,396

(22) PCT Filed: Sep. 30, 2002

(86) PCT No.: PCT/US02/30995

§ 371 (c)(1),
(2), (4) Date: May 5, 2004

(87) PCT Pub. No.: WO03/029535

PCT Pub. Date: Apr. 10, 2003

(65) Prior Publication Data

US 2004/0232602 A1 Nov. 25, 2004

(51) Int. Cl.
*B29C 39/14* (2006.01)
*B29C 43/22* (2006.01)

(52) U.S. Cl. ..... 264/555; 264/638; 264/639; 264/677; 264/556; 264/559

(58) Field of Classification Search ..... 264/555, 264/342, 638, 639, 677, 556, 559, 112, 113, 264/116, 118, 130, 131, 145, 148, 152, 157–160, 264/171.1, 171.17, 241, 257, 258, 291, 288.4, 264/297.4
See application file for complete search history.

(56) References Cited

U.S. PATENT DOCUMENTS

| | | | | |
|---|---|---|---|---|
| 2,209,850 | A * | 7/1940 | Shand et al. | 156/148 |
| 4,351,683 | A * | 9/1982 | Kusilek | 156/167 |
| 5,582,905 | A * | 12/1996 | Beck et al. | 428/74 |
| 5,958,322 | A * | 9/1999 | Thompson et al. | 264/342 RE |
| 2004/0159658 | A1 * | 8/2004 | McLaughlin et al. | 220/4.21 |

* cited by examiner

*Primary Examiner*—Christina Johnson
*Assistant Examiner*—Stella Yi
(74) *Attorney, Agent, or Firm*—Davis & Bujold, P.L.L.C.

(57) ABSTRACT

A method of producing a non-lofted fiber veil of an orientable polymer for the production of insulation, e.g. thermal, for blown-in applications, having X, Y and Z vector directions of the fibers comprising, melt blowing the polymer to form molten fibers, having molecules oriented along the length of the fibers, the X vector direction, placing the fibers on a roller spinning at a rate to provide additional orientation of the molecules of the fibers, displacing some said fibers into the Y vector direction, and cooling the fibers while on the roller to form the non-lofted fiber veil. Also included is the product of the method, a blown in insulation, intermediate products, an apparatus and a method of producing a product for blown-in installation.

15 Claims, 8 Drawing Sheets

PROCESS OF AND APPARATUS FOR MAKING AN INSULATION PRODUCT

This invention relates to a new apparatus and method for producing a new product useful as a blown in insulation and made of a orientable polymer (preferably heat setable), e.g. PET, and the new product itself.

BACKGROUND OF THE INVENTION

Insulation products made from polymer fibers are not new as there are several products in the marketplace, however, most of these applications are for clothing apparel and the like. Blown-in insulation of homes and buildings generally use fiberglass or cellulose.

There are environmental hazards and inefficiencies using these other materials. For example, fiberglass and cellulose will break apart into fine particles when put through conventional blow-in insulation equipment. These fine particles are hazardous to human beings upon breathing large quantities thereof. In addition, both materials, fiberglass and cellulose, are inferior to polymer (specifically PET) fibers for performance in insulation value and other measurable physical characteristics (such as cycling through wet and dry conditions).

In the present invention polymer fiber is made by way of a preferred process generally called melt blowing. This method is known in the plastics converting industry as a method to form small diameter fibers. U.S. Pat. No. 5,582,905 assigned to the assignee of the present application discloses a method of making continuous fibers, collecting the fibers and making a batt (lofted in the z direction).

Fiber (and products) made from the melt blowing process have typically been limited by the properties generated from the melt blow process.

OBJECT OF THE INVENTION

It is an object of the present invention to overcome the environmental disadvantages of the prior art blown in insulation and to provide an environmentally safe stable lofted polymer insulation having an insulation value superior to the prior art.

SUMMARY OF THE PRESENT INVENTION

Products of the present invention typically are continuous fibers laid out in a thin web sheet (veil) in the X and Y directions with little or no loft (Z direction).

The new product of this invention disclosed herein is a non-lofted veil made from a fiber that, produced as a non-lofted veil with fibers in the X and Y direction, is processed to improve its properties and then is cut into short segments (1 to 30 mm long) compactly bundled for expansion on location. A significant portion of the fibers of these segments extend in the Z direction upon compaction. When the final product is made the fibers are substantially evenly dispersed into the X, Y and Z directions.

The present invention enhances the quality of the fiber and the end product (mass of fibers). Specifically, high levels of orientation (in fibers, it is generally monoaxial orientation) and crystallinity are the properties desired for fibers used in insulation product such as blown-in attic insulation. Products such as filtration media where the fibers are enclosed within a structure can utilize even smaller fibers.

Disclosed is a fiber product for blown-in insulation, made by way of several steps including orientation via the hot air followed by quenching to lock in orientation. Additional orientation is added downstream to the fibers and web by way of further heating mechanical actions including crystallization of the oriented fiber. The fiber is oriented 3 (or more) times during the process under different conditions.

Specifically a controlled web (veil), essentially a 2 direction (X and Y) product, is produced in which the fibers are oriented twice in the X direction and then a fractional component of the oriented X direction is redirected to lay in the Y direction. This is accomplished by use of the hot air flow in the X direction and the turbulent currents created by that flow and presence of a mechanical roller.

Nodal points (where 2 fibers cross each other and fast with each other at that point) are created in the X and Y vector (X=machine direction, Y=cross machine direction) to create more and stronger Z direction fiber in the blown-in product.

Following this the cutting and compaction of the web directs a substantial portion of the fibers into the Z direction which is then packaged. Subsequently blowing (expanding) the product randomizes the X, Y and Z direction fibers to create random matrixes. The physical connections to build loft comes about as individual packets are expanded with multiple nodes within each packet. Loft comes about when each packet builds on one another with physical entanglements generated thru the expansion process making the connections between packets.

The invention provides:

a) a new product in the form of a blown-in insulated material made from short polymer fibers with respect to which several intermediate steps in the overall process give the final product key performance characteristics: b) the product is made by way of a modified melt blowing system with modifications providing higher levels of orientation and thermal stability to the fibers, small intermediate compressed packets for better handling and final low bulk density with high loft and high insulating value product; and c) new hardware adapted to work the molecules of the fiber to achieve the blown-in insulation product.

In order to maximize the properties of the fiber and the product (blown-in insulation) the new blown-in product has several steps by which it is formed.

The process comprises:

1) Fiber formation with a $1^{st}$ orientation;

2) $2^{nd}$ orientation of the fiber;

3) Redirection of some fibers to the Y direction, nodes created

4) Quench to lock in orientation

5) Additional crystallization to the fiber

6) Coating the fiber 7) 3rd orientation of fiber

8) Cutting fiber (multiple layers)

9) Compacted packets of fiber

10) Packaged (compressed) packets

11) Re-expanded fiber expands around nodes (and entanglements).

According to the invention there is provided a method of producing a non-lofted fiber veil of an orientable polymer for the production of insulation for blown-in applications having X, Y and Z vector directions of the fibers comprising: a) melt blowing the polymer to form molten fibers; b) using a high velocity air flow to orient molecules of the fibers along the length of the fibers, the X vector direction; c) placing the fibers on a mechanical roller adjacent the air flow which is spinning at a rate to provide additional orientation of the molecules of the fibers in the X vector direction as the fibers move across the air flow to the roller; d) using air flow turbulence and roller placement to displace some said fibers into the Y vector direction; and e) cooling the roller to solidify the fibers while on the roller to form the non-lofted fiber veil.

More specifically according to the invention there is also provided a method of producing a non-lofted fiber veil of an orientable polymer for the production of insulation for blown-in applications having X, Y and Z vectors comprising: a) extruding the polymer by melt blowing to form molten fibers; b) directing a high velocity hot air flow around the extruded fibers with both the air flow and the length of the fibers having the same direction, the X vector direction, to carry the fibers in said direction and to orient the molecules of the fibers along the X vector direction of the fibers; c) locating a mechanical roller adjacent to the fibers being carried in said direction; d) placing the fibers on the roller which is spinning in a direction to carry the fibers away from the air flow; e) choosing a rate of rotation of the roller whereby force generated by the air flow pushing in said direction and the fibers moving across the air flow to the roller yields additional orientation of the molecules of the fibers in the X vector direction; f) placing the roller so that the placement of the roller and turbulence created by the air flow causes a percentage of the fibers to be displaced into a transverse direction, the Y vector; and g) cooling the roller to quench the fibers, after orientation of the molecules thereof subsequent to removal of the fibers from the air flow as they pass over the roller to prevent loss of orientation of the molecules, to form the non-lofted fiber veil.

Also a feature of the invention is the product of the methods of the previous two paragraphs.

Also according to the invention there is provided an apparatus for producing a non-lofted fiber veil of an orientable polymer for the production of insulation for blown-in applications having X, Y and Z vector directions of the fibers comprising: a) a melt blowing station for blowing the polymer to form molten fibers encompassed by using a high velocity air flow to orient molecules of the fibers along the length of the fibers, the X vector direction; b) a mechanical roller adjacent the air flow arranged to spin at a rate to provide additional orientation of the molecules of the fibers in the X vector direction as the fibers leave the air flow to reach to the roller; and together with air flow turbulence and placement of the roller, to displace some said fibers into the Y vector direction; and c) cooling means associated with the roller to solidify the fibers while on the roller to form the non-lofted fiber veil.

The invention further provides a non-lofted oriented polymer insulation for blown-in applications comprising multiple layers of oriented polymer veils compressed together and cut to form R-Buds of multiple layers of polymer fibers entangled and connected by nodes expandable upon installation to provide a blown-in insulation.

Also the invention provides an R-Bud for use in forming a matrix of insulation for blown-in applications of an orientable polymer comprising multiple superimposed layers of non-lofted veils, formed by fibers of said polymer disposed in both of X and Y vectors of X, Y and Z vectors, the veils being interconnected by fibers extending along the Z vector.

The invention also includes a blown-in insulation comprising a plurality of R-Buds according to the preceding paragraph each expanded to produce the insulation as a matrix of expanded R-Buds.

The invention further provides a method of producing a blown-in insulation from an orientable polymer comprising: a) producing a plurality of non-lofted veils each having a plurality of fibers of the polymer extending and interconnected in X and Y vectors of X, Y and Z vectors; b) superimposing the-veils and compressing these together to produce interconnection of the layers along the Z vector; c) cutting the interconnected layers into a plurality of R-Buds; and d) expanding the R-Buds, at the time of installation of the insulation, to form blown in insulation comprising a large plurality of the R-Buds.

BRIEF DESCRIPTION OF THE DRAWINGS

The invention will now be described, by way of example, with reference to the accompanying drawings in which.

DESCRIPTION OF PREFERRED EMBODIMENTS

Figure 1:
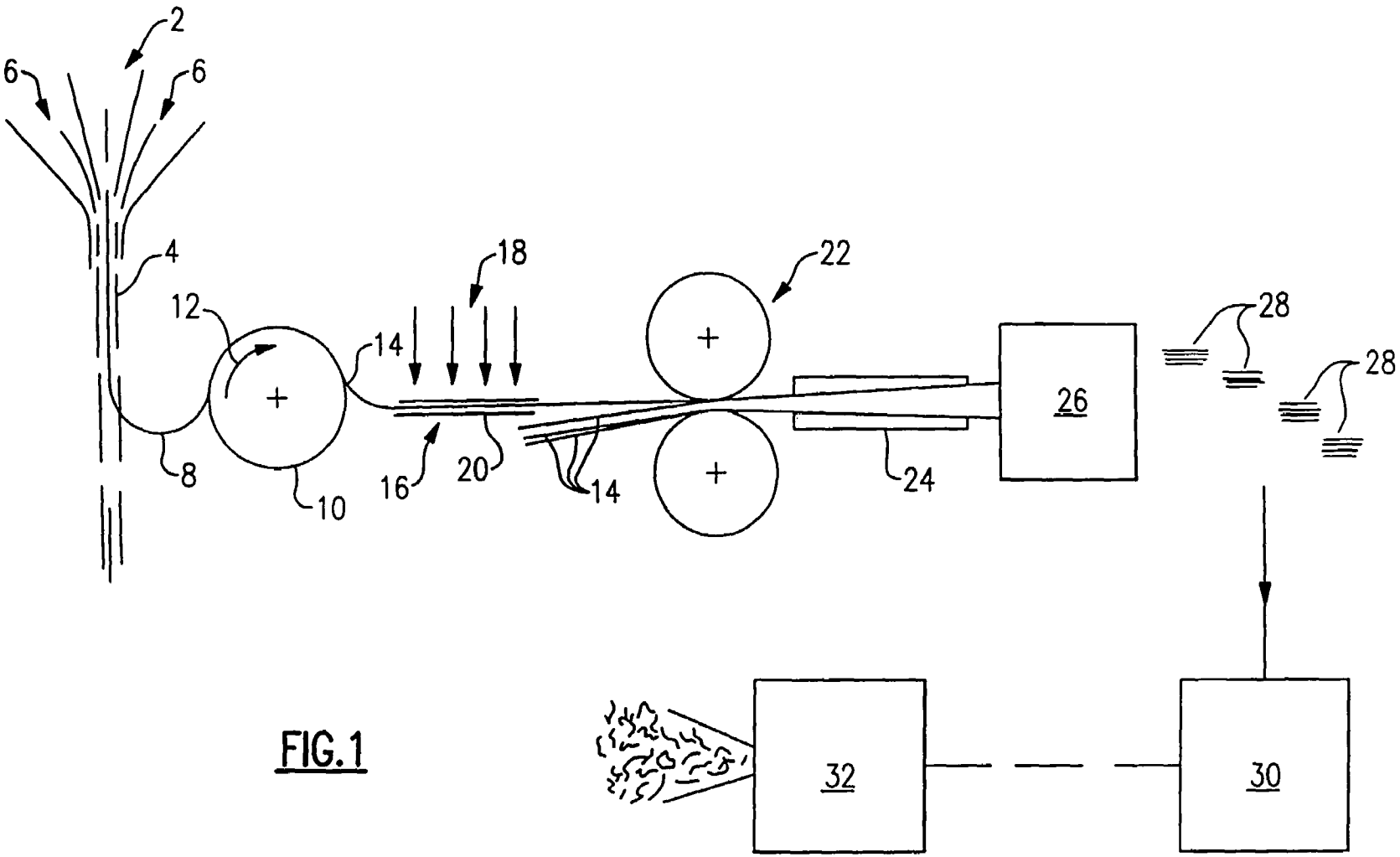
FIG. 1 is a diagrammatic schematic of apparatus according to the invention also illustrating the steps of the method according to the invention.
Figure 2:
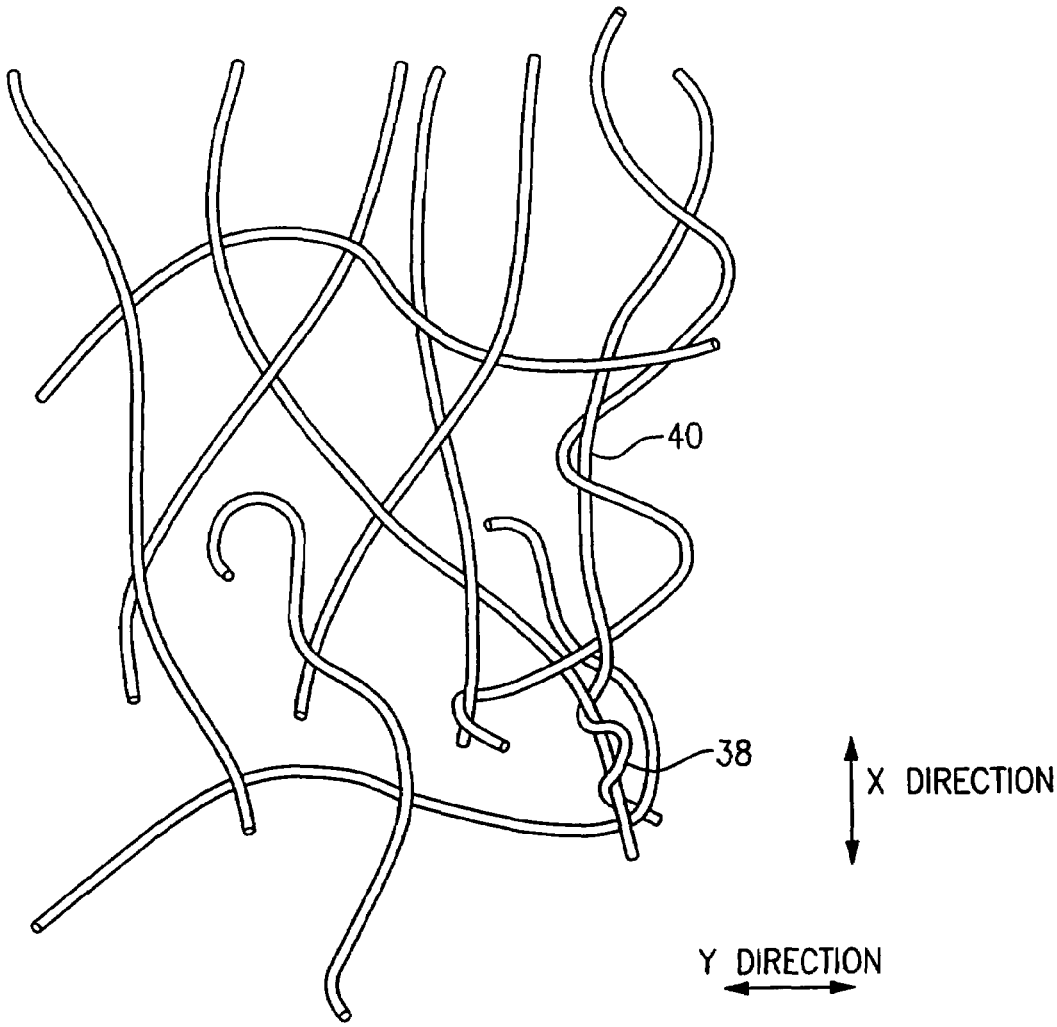
FIG. 2 is a sketch showing the veil in the X and Y direction with node points 38 and 40 which continue to remain intact after cutting and compaction as shown in FIGS. 3-10.
Figure 3:
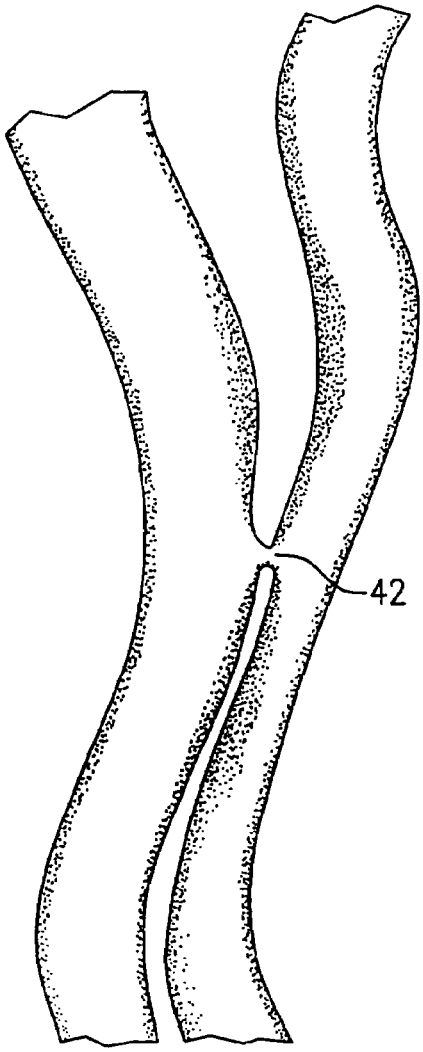
FIGS. 3-10 are diagrammatic sketches, micro-photographs and a drawing showing a combination of features all illustrating features of the blown and expanded R-Buds providing for their stable entanglement to provide a lofted insulation.
Figure 4:
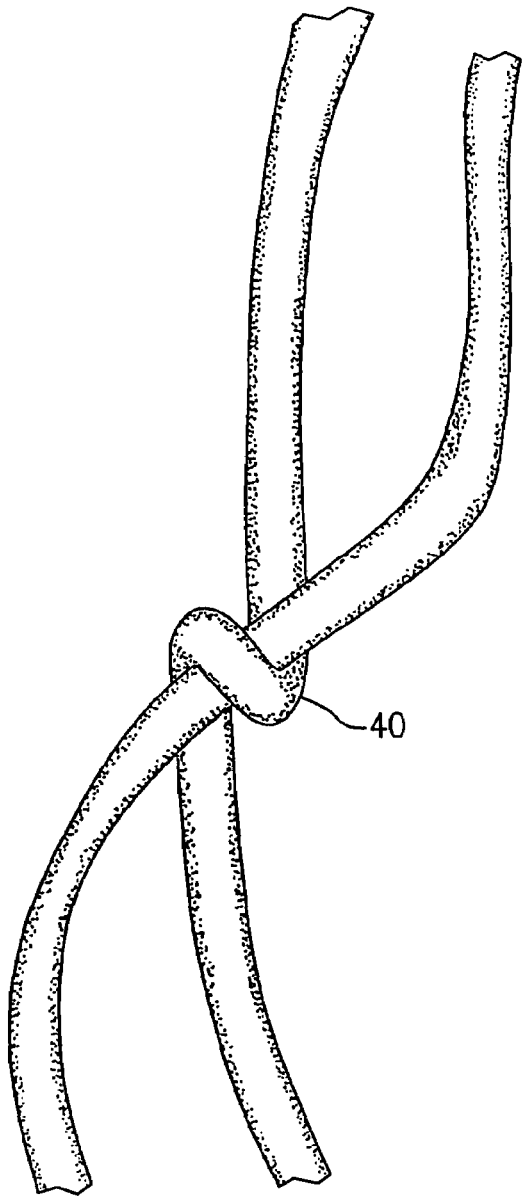
Figure 5:
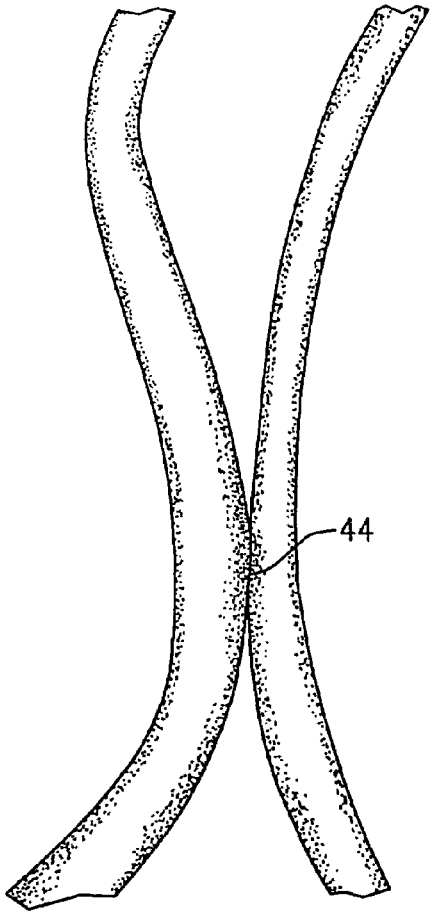
Figure 6:
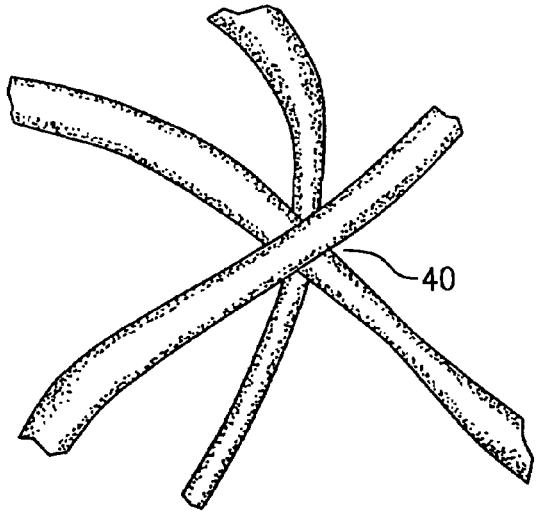
Figure 7:
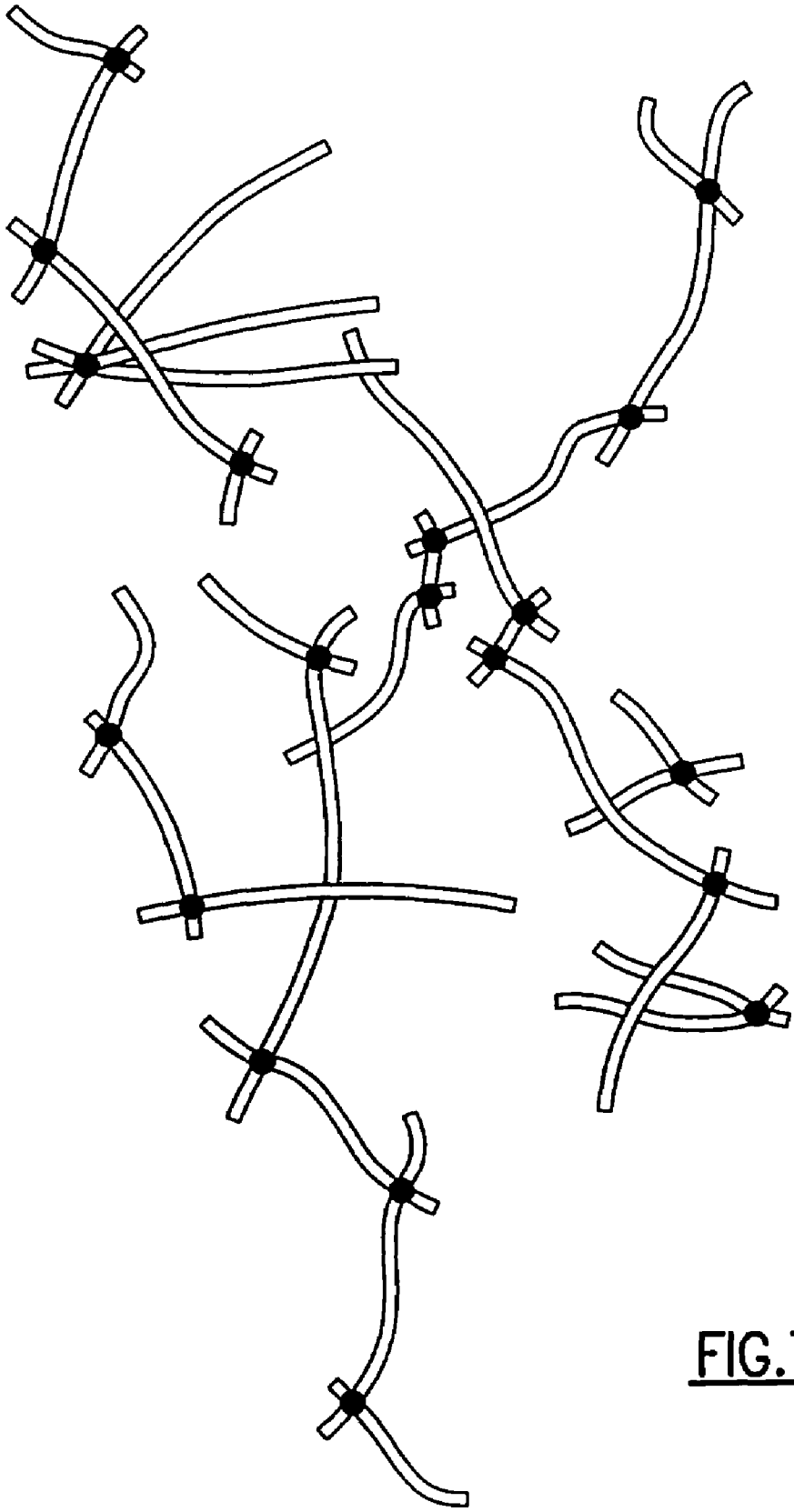

The apparatus illustrated in FIG. 1 comprises a melt blowing die apparatus 2 for melt blowing molten synthetic fibers entrained in a curtain 4 of air 6 emitted vertically at high speed parallel to the spun fibers at a temperature of about 600° F. ±100° F. The fibers extend primarily in an x direction and may comprise a polyester (i.e. PET) issuing from the nozzles of the apparatus 2 with a diameter of typically about 0.2 to 0.5 mm. These fibers are attenuated, oriented and fibrillated by the curtain of hot air to a statistical mean of about 5 to 15 microns (NOTE 1000 microns=1 mm) while at the same time molecular orientation takes place as the hot air quickly cools to an orientation temperature of about 200° F.

One of the major limitations to melt blowing in the prior art is that the hot air remains in contact with the fiber. The hot air keeps the fiber above Tg (glass transition temperature) which relaxes the molecules within the fiber thus reducing the orientation of the fiber. Better orientation can be achieved if the fiber after orientation is quenched. This locks in the orientation of the molecules otherwise orientation is lost through relaxation.

In view of this the fibers are removed from the air stream forming a loop 8 extending to a cold roller 10 rotating in the direction of arrow 12. The loop 8 provides a second orientation of the fibers which are then quenched on the roller 10 to lock in the orientation. At this stage the fibers form a substantially single layer web- or veil 14 with the majority of fibers in the x direction and some fibers extending in the Y direction of the veil comprising 10-20% of the fibers and with virtually no fibers extending in the Z direction (e.g. out of the plane of the veil).

It should be noted that there are two types of crystallinity; that induced by mechanical stretching and that formed by thermal energy. It is desirable to form high levels of mechanical crystallinity (orientation) first, and maintain these orientation levels (so as not to lose them through thermal relaxation) and then induce thermal crystals. Standard melt blowing processes give too low a level of orientation and gives thermal crystallization at the wrong time and in a poor manner.

For insulation products, a higher level of orientation is desired. This orientation will improve physical strength and toughness of the fiber as well as enhancing thermal stability of the fiber. The higher the orientation one can impart to the fiber the thinner the fiber diameter can be made so that the fiber and the mass of fibers will not collapse under its own weight. In turn, building a matrix of fine fibers allows a better insulating product as the matrix impedes the flow of air thus providing greater insulating value.

A characteristic of PET (and some other crystalline resins) is that it can be oriented which increases the crystallinity level via mechanical action but with PET one can also add crystallinity by way of adding thermal energy that allows crystals to grow. The term heat setting is used in the PET industry to describe crystalline growth through the addition of thermal energy. If the molecules are allowed to relax during heat setting then orientation will be lowered. With standard melt blowing, a good portion of the orientation is lost due to the thermal temperatures of the hot air used to draw the fiber, as the fiber is not restrained. In addition, exposure of the fiber to the hot air yields thermal crystallization. Thermal crystallization without good orientation yields a fiber that is brittle. In addition, the thermal relaxation of orientation causes the fiber diameter to increase as the 'memory' of the fiber tries to bring the fiber to its original (larger) fiber diameter. The increased thickness of the fiber is ineffective for insulation and filter products as it changes the bulk density of the final product.

Thus one or more veils 14 is then passed through a heat setting station 16 in which the veil 14 is restrained in both the X and Y directions to prevent shrinkage while being heated to crystallize the fibers using hot air represented by arrows 18. Other heating sources could be used i.e. infra red, radio frequency, etc. The restraint is shown diagrammatically at 20 and may comprise webs, plates, veil edge gripping devices, veil gripping porous conveyers etc.

Following heat setting additional veils 14 are added in overlapping manner to be fed together to a coating station 22 which may comprise coating rollers between which the multiple veils pass to be coated by a lubricant (i.e. a short chain polymer). The multiple veils leave the coating station still extending primarily only in the X and Y directions.

After coating the multiple veils are passed through a tow forming station 24 to a tow cutting station 26. The amount of coating can be used to control density in the final blown product. The tow is formed by pressing the multiple veils together in the Y direction to produce an overlapping fiber tow having X, Y and Z dimensions using control plates, rollers, etc. to produce a tow having substantially identical Y and Z dimensions. The cutting station 26 can operate faster than the supply rate of the veils supplied by the coating station 22 thereby cold drawing and further increasing molecular orientation of the fibers and decreasing their diameters.

The cutting station comprises a standard cutter unit which is adjusted as to speed and tension to cut the tow into compact R-Buds 28 of a desired tightness or density. The cutting operation also increases the proportion of fibers extending in the Z direction. The R-Buds are each of a basically rectangular packet configuration which are then compactly packaged at a packaging station 30 into bags for distribution to an end user.

The end user who is to install blown-in insulation may use a standard blown insulation installer 32 to expand the R-Buds 28 and add transport air to produce expanded packets of insulation from the R-Buds 28 which become entangled with one another to produce a stable lofted insulation 34 free of binders and brittle components coated only with a lubricant coating.

The lofted material is suitable not only for thermal but also sound insulation and is also useful as a fibration material among many other potential environmentally non-hazardness uses.

The re-expansion results in the actual installed product. The final bulk density can be controlled by the amount of mechanical action, velocity of air, coating material or coating amount. The expansion takes place when the R-Buds are put into a mechanical action machine which via a scouring action and the use of air to blow the product takes the compacted R-Buds and expands them into a product that is a 3 dimensional random matrix comprising fibers in equal proportion in the X, Y and Z directions. The bulk density can range from 0.25 to 2 lbs per cubic foot.

Typical Densities, in lb/cu.ft, of articles

Veil 0.8+/−0.1

R-Buds 12.5+/−5

Packaged R-Buds 17.5+/−5

Expanded 0.25–0.5

Standard mean fiber diameters from melt blowing operations range from 10 to 50 microns. In insulation, it is better to have smaller diameters but strong fibers. The range of fiber diameters for insulation products will vary depending on final application specifications but can generally be characterized into 2 groups; 1 to 10 micron average diameter and sub-micron 0.1 to 1 micron average. It has been found that for the blown-in insulation product a preferred statistical mean diameter should be in the 2 to 7 micron range.

The term density can apply to several areas. The individual fiber has a density that is often measured to calculate the degree of crystallization. The term bulk density is used to describe the density of the mass of fibers. For shipping and other purposes, a high bulk density is preferred so as to save space, freight, etc. When the product is used as an insulating material a low bulk density is preferred so as to be cost efficient. The blown-in insulation product also has a yield factor whereby the fiber diameter is critical to thermal insulation efficiency and cost. A smaller fiber diameter which for the same weight per given volume will yield more fibers thus better insulation than a larger diameter fiber.

For example a product may have the same fiber density and bulk density but very different yield with different fiber diameters. This yield is important to creating a matrix to trap airflow thus providing insulating value. Example: one fiber with a diameter of 0.015 mm and 10 mm long with a density of 1.35 grams/cc has a total mass of $2.4\times10^{-6}$ grams. Using the same fiber density, mass and length and adjusting the diameter to 0.0075 mm (half the original) then 4 fibers can be made instead of the one. Nine (9) fibers can be made from the same mass if the diameter is adjusted to 0.005 mm (5 microns). [Note: 1.000 micron=1 mm)

Thus it is easily determined that the smaller fibers will give a more complex matrix if the fibers are suitably randomized in the X, Y and Z directions. Please note though, at average fiber diameters of less than 3 microns the fiber strength begins to become too weak to support itself in a stand-alone condition/position.

Referring now to FIGS. 2-10 various nodes and entanglement of the veil and expanded R-Buds 28 is illustrated with reference to the various mechanisms providing a stable lofted product. The redirected Y vector fiber is important to the final product. Interaction of the Y direction fibers with the X direction fibers is very important so as to create a 'veil' (web). This veil is made of X and Y fibers that hang together forming a web. The X and Y fibers hang together by several means. The intersections at which they meet are called nodes. These nodes can be formed by several means; entanglements (including twistings) 38, friction/hang ups 40, welding 42, intermolecular attraction 44 due to polarity of the molecules, etc.

Entanglements are those fibers that wrap around another. Friction/hang ups are where the two fibers intersect and slide until caught at a node. This would be similar to a branch falling from a tree and getting caught in the limbs of a tree (where the limbs intersect the body or larger limb). Weld points are created when the hot fibers touch one another and then are frozen in place by the cold roller. Intermolecular attraction is present in several forms. When oriented a molecule will have a degree of polarity created. The opposite poles will attract and keep fibers together. Further, the fibers rubbing against one another creates static, which in turn, will keep the fibers bonded together.

The X direction fibers are more oriented than the Y direction fibers but even the Y vector fibers have a degree of orientation and thus have better strength than non-oriented fibers.

Figure 8:
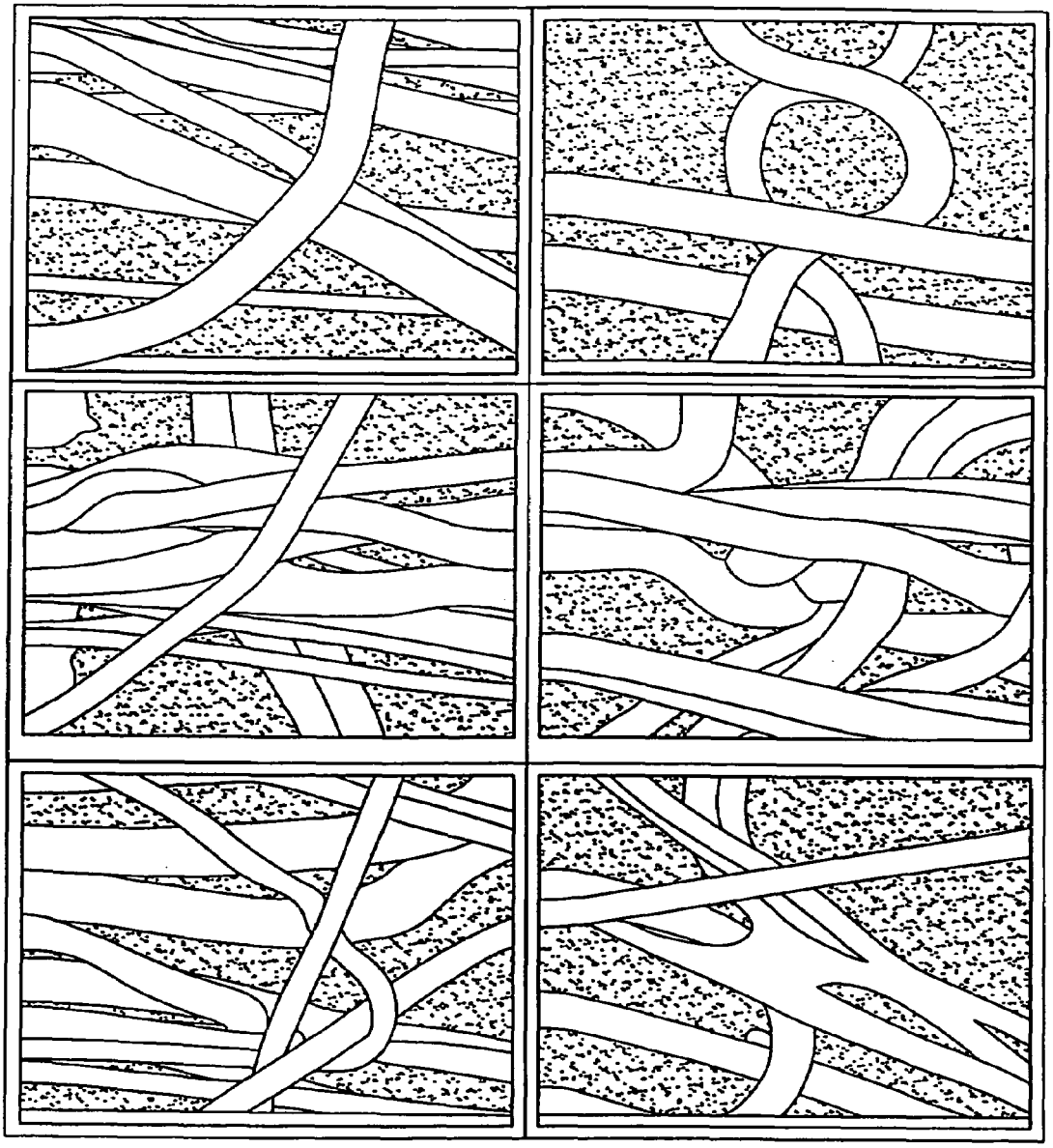
Figure 9:
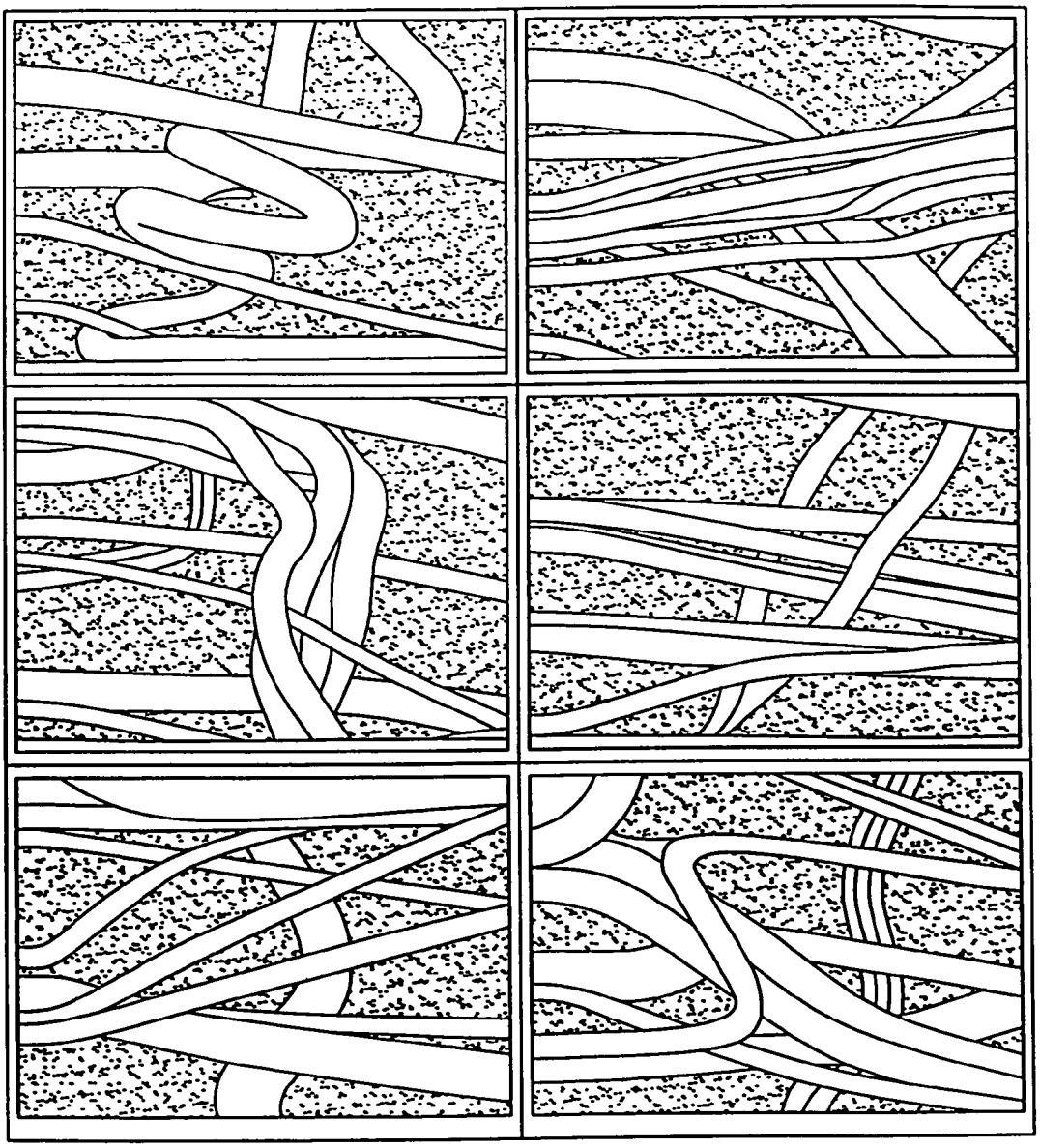
Figure 10:
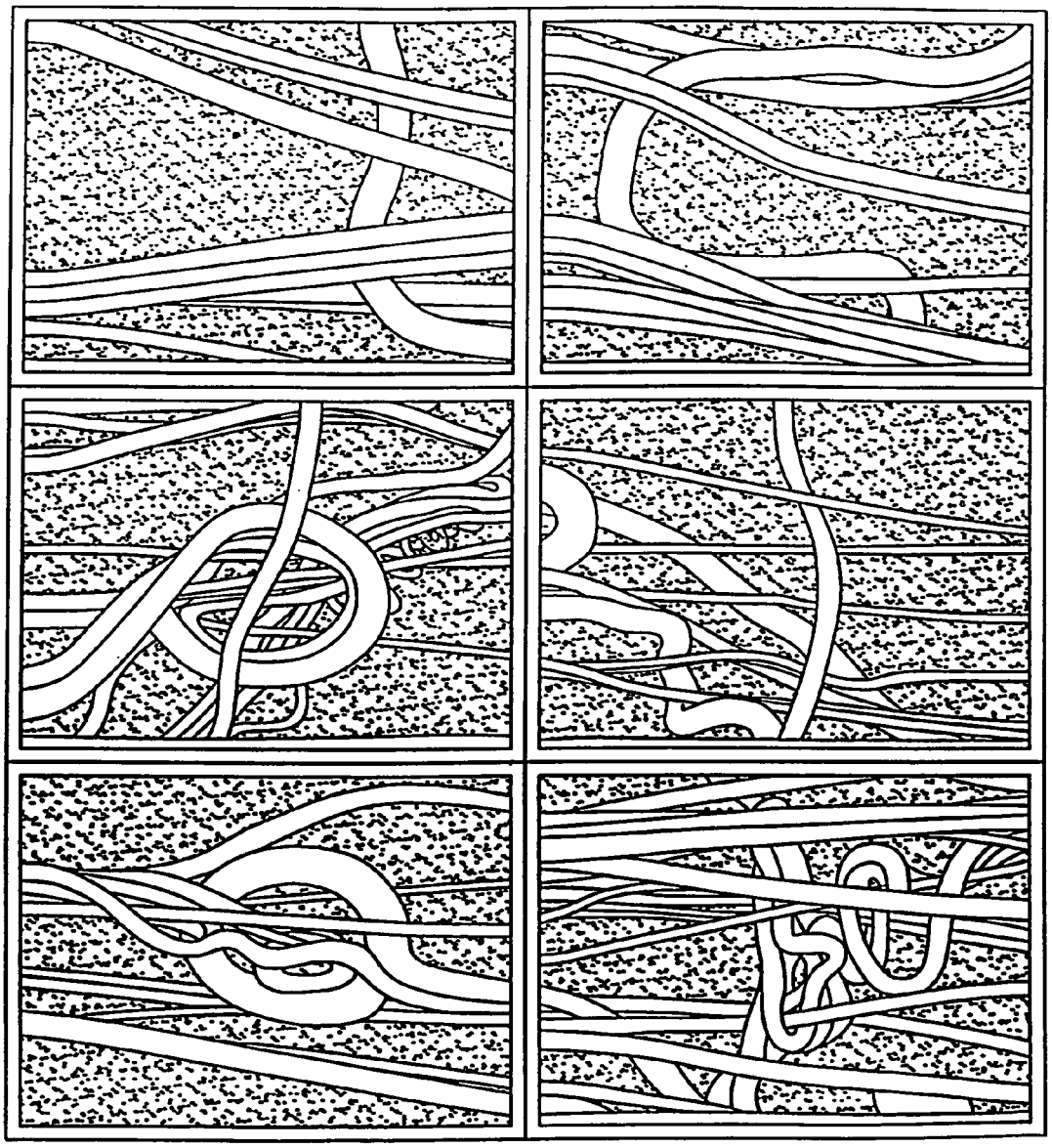

The micro-photographs of FIGS. 8, 9 and 10 illustrate the complexity of intermixed mechanisms controlling the stability of the lofted product after expansion.

The preferred insulation material is one that is composed of fibers that are thermally stable and have good strength and stiffness. Fibers that are weak will yield under a force. Fibers that are not thermally stable will collapse (due to gravitational force) or distort (shrinkage) upon exposure to elevated temperatures. Fibers that are brittle will break when exposed to any force. In turn, when the fibers are affected the entire insulation product is impacted thus the produce fails.

A fiber that has good orientation and has been given thermal stability (such as heat setting) will provide a fiber that will make up a good insulation product.

| Orientation | Thermal Crystallization | Result |
|---|---|---|
| Low | High | Brittle fiber |
| Low | Low | Produce collapses when exposed to higher temps |
| High | Low | Product shrinks and distorts when exposed to higher temps |
| High | High | Stable/strong product |

The preferred method of the present invention comprises:

1. First orientation of fiber: Fiber formation has remained the same as described in previous patent applications assigned to the assignee of the present application. The fiber is extruded from a die which has a multitude of openings (holes, or the like) on the order of 0.5 mm in diameter. This hot extrudate is pushed out of the die hole and forms a molten fiber. High velocity air (e.g. hot for PET or cold for polypropylene) is directed around the newly formed fiber with both air and fiber directed in the same axis. (For this discussion; vertical direction) This air quickly carries the molten fiber downwardly and begins to orient the fiber;

2. Second orientation: Instead of keeping the fiber in the hot air until collected, a mechanical roller is located such that it is adjacent to the stream of fibers. See FIG. 1. The fibers are placed on the roller which is spinning. The downward force of the air orients the fiber. The preferred process is such that the fiber forms somewhat of an 'J' shape with a half loop at the bottom of the airflow. This force generated by the air pushing downwardly and the fiber trying to move across the airflow yield to produce more orientation as the fiber has restraints and cannot relax. This can be controlled by the vertical and horizontal position of the rollers.

3. Y direction: Due to the placement of the roller and the turbulence created by the flow of air a percentage of individual fibers are displaced into the Y vector. The % and diameters of the Y direction fibers can be managed by the RPM and location of the roller relative to the fiber formation;

4. Quench: The rotating roller is cool to cold from internal cooling. This cold temperature quenches the oriented molecules in place. Further, the molecules are removed from the hot air to prevent relaxation (loss of orientation) of the molecules. The roller may be designed, i.e. as a corkscrew. to place the Y vector fibers in tension;

5. Added crystallization: Depending on the specifications, the fibers may need additional thermal crystallization once they have been orientated. To add thermal crystallization, the fibers are restrained in both the X and Y directions while heat is applied. After sufficient time has elapsed to achieve desired crystallization the fibers have to be quenched while still restrained;

6. Coating: To enhance the cutting, compacting and re-expansion of the fibers, it is sometimes desirable to coat the fibers with a lubricant. This lubricant allows faster cutting and compaction and allows a lower installed density upon re-expansion of the fibers;

7. Third orientation: Third orientation of the fibers is performed when the fibers are put into the cutter (tow cutter) that can run at a higher speed than the roller feeding it. The fibers are cold drawn adding additional-orientation to the fiber;

8. Cutting: Cutting the fiber is accomplished by use of device called a tow cutter. To get optimum performance, several veils are laid on top of one another and then bunched together to form a unit that is like a narrow non-woven rope. The bunching of the veils creates further complexion to the orientation of the fibers. Further entanglements form additional nodes. These bunched veils are cut into packets on the order of 0.400 inches+/−0.300 inches in height;

9. Compacting: The fibers are purposely compacted in the tow cutter. This is accomplished by changing the machine process conditions so that discrete 3 dimensional rectangles with compacted fibers are formed. The compacted fibers are formed into an R-Bud. The dimensions of the R-Bud are approximately 0.125 inch wide and 0.375 inch in depth. These packets (R-Buds) are loosely compacted such that friction or the like mechanical action will cause them to come apart. It should be noted that the R-Buds are formed from the veil so that upon dissecting the R-Buds one finds portions of a mini-veil. The fibers are running in the X, Y and now Z directions relative to the R-Bud. The Z direction fibers are important to note as when the R-Bud is expanded into blown in insulation, the fibers then form a 3 dimensional matrix;

10. Packaging: For ease of shipment the R-Buds are packaged into a secondary package and some additional compression is added to increase the bulk density. This will ease the cost of freight and handling; and 11. Expanding: Expanding the R-Buds via a machine that will expand the R-Buds around the nodes and entanglements to produce a stable lofted product made up of a matrix of the expanded R-Buds, with superior insulating values due to the random 3D matrix of fibers created around the nodes.

| Reference numerals | |
|---|---|
| 2 | melt blowing apparatus |
| 4 | curtain |
| 6 | air |
| 8 | loop |

-continued

| Reference numerals | |
|---|---|
| 10 | roller |
| 12 | arrow |
| 14 | veil |
| 16 | heat setting station |
| 18 | heat arrows |
| 20 | restraint |
| 22 | coating station |
| 24 | tow forming station |
| 26 | cutting station |
| 28 | R-Buds |
| 30 | packaging sation |
| 32 | blow installer |
| 34 | lofted insulation |
| 38 | entanglement nodes |
| 40 | hang up nodes |
| 42 | welded nodes |
| 44 | static bond nodes |

We claim:

1. A method of producing a substantially single layer non-lofted fiber veil of an orientable polymer for the production of insulation for a blown-in application having X, Y and Z vector directions, the method comprising steps of:

a) extruding the polymer by melt blowing to form molten fibers;

b) directing a high velocity hot air flow around the extruded fibers with both the air flow and a length of the fibers having a common direction, the X vector direction, to carry the fibers in said X vector direction and to orient molecules of the fibers substantially along the X vector direction of the fibers;

c) locating a mechanical cold roller adjacent to the fibers being carried in said X vector direction, and the cold roller being spaced and offset from the high velocity hot air flow in the X vector direction such that the fibers are removed from the high velocity hot air flow by a removal loop, prior to the fibers engaging with the cold roller;

d) placing the fibers on the cold roller which is spinning in a direction to carry the fibers further away from the air flow in the X vector direction;

e) choosing a rate of rotation of the cold roller whereby a force generated by the air flow pushing in said X vector direction and the fibers moving across the air flow in the removal loop toward the cold roller yields additional orientation of the fibers in the X vector direction;

f) placing the cold roller so a placement of the cold roller and turbulence created by the air flow causes a percentage of the fibers to be displaced into a transverse direction, the Y vector direction;

g) cooling the cold roller to quench the fibers, after the additional orientation of the molecules thereof and subsequent to removal of the fibers from the air flow, as the fibers pass over the cold roller to prevent loss of orientation of the molecules and form the substantially single layer non-lofted fiber veil and;

h) applying tension to the substantially single layer non-lofted fiber veil, prior to cutting the substantially single layer non-lofted fiber veil, to facilitate further alignment of the fibers in the X vector direction and minimize any alignment of the fibers in the Y and Z vector directions.

2. The method of claim 1 further comprising the step of heat setting the non-lofted fiber veil by restraining the veil formed in step f) in both the X and Y vector directions, heating the restrained veil for a period of time and at a temperature to produce a desired crystallinity of the fibers of the veil, and quenching the heated veil while still restrained.

3. The method of claim 2 further comprising the step of coating the fibers of the crystallized and quenched veil with a lubricant to facilitate faster cutting and compaction and provide for a lower installed density, upon expansion of a blown in insulation formed from a plurality of the veils.

4. The method of claim 1 further comprising the step of cutting the veil in a tow cutter into a plurality of R-Buds having a height of about 0.4 inches (10 mm) +/−0.3 inches (8 mm).

5. A method of producing a substantially single layer non-lofted fiber veil of an orientable polymer for the production of insulation for a blown-in application having X, Y and Z vector directions, the method comprising the steps of:

a) extruding the polymer by melt blowing to form extruded fibers;

b) directing a high velocity hot air flow around the extruded fibers with both the air flow and a length of the fibers having a common direction, the X vector direction, to carry the fibers in the X vector direction and to orient molecules of the fibers along the X vector direction of the extruded fibers;

c) locating a mechanical cold roller adjacent to the extruded fibers being carried in the X vector direction such that the fibers are removed from the high velocity hot air flow by a removal loop, prior to the fibers engaging with the cold roller;

d) placing the extruded fibers on the cold roller which is spinning so as to carry the fibers away from the air flow;

e) choosing a rate of rotation of the cold roller whereby a force generated by the air flow pushing in the X vector direction and the fibers moving across the air flow in the removal loop toward the cold roller yields additional orientation of the molecules of the fibers in the X vector direction;

f) placing the cold roller so that the placement of the cold roller and turbulence created by the air flow causes a percentage of the fibers to be displaced into a transverse Y vector direction;

g) heat setting the non-lofted fiber veil by restraining the veil formed in step f) in both the X and Y vector directions, heating the restrained veil for a period of time and at a temperature to produce desired crystallinity of the fibers of the veil;

h) cooling the cold roller to quench the extruded fibers, after orientation of the molecules thereof and subsequent to removal of the fibers from the air flow as the fibers pass over the cold roller to prevent loss of orientation of the molecules and form the substantially single layer non-lofted fiber veil;

j) applying tension to the substantially single layer non-lofted fiber veil, prior to cutting the substantially single layer non-lofted fiber veil, to facilitate further alignment of the fibers in the X vector direction and minimize any alignment of the fibers in the Y and Z vector directions prior to cutting the substantially single layer non-lofted fiber veil in a tow cutter; and j) laying a plurality of the veils on top of one another and compressing the plurality of the veils together to form a non-woven multi-layer structure of fibers having substantially most of the fibers extending in the X vector direction.

6. The method of claim 5 further comprising the step of mechanically bunching the veils together to form entanglements and nodes in addition to those formed in prior steps of the method.

7. The method of claim 5 further comprising the step of cutting the bunched veils to form R-Buds of about 0.4 inches (10 mm) +/−0.3 inches (8 mm) in height.

8. The method of claim 5 further comprising the step of compacting the bunched veils so that the bunched veils have X, Y and Z dimensions, and cutting the compacted veils to form three dimensional R-Buds having fibers extending substantially in the X vector direction.

9. The method of claim 8 wherein the R-Buds are about 0.125 inches (3 mm) wide and about 0.375 inches (10 mm) in depth with the R-Buds being loosely compacted such that mechanical action will cause the R-Buds to separate and come apart.

10. The method of claim 9 further comprising the step of compressing and packaging the R-Buds into a secondary package to increase the bulk density and thereby to reduce the cost of freight and handling.

11. The method of claim 9 further comprising the step of expanding the R-Buds around nodes and entanglements in the R-Buds to produce blown-in insulation in a stable lofted form.

12. The method of claim 1 wherein said X vector direction is vertically downward.

13. The method of claim 1 wherein the molten fibers in the melt blowing step are about 0.02 inches (0.5 mm) in diameter.

14. The method of claim 1 wherein the periphery of the cold roller is shaped to facilitate displacement of fibers into the Y vector direction.

15. A method of producing an insulation for blown-in applications from an orientable polymer, the method comprising the steps of:

a) producing a plurality of non-lofted veils, each of the plurality of non-lofted veils being substantially a single layer having a plurality of fibers of the polymer extending substantially in the X vector direction and engaging each substantially single layer non-lofted veil with a cold roller, following formation thereof, to quench the fibers of the polymer and prevent loss of molecule orientation, the cold roller being spaced and offset from a high velocity hot air flow in the X vector direction such that the fibers are removed from the high velocity hot air flow by a removal loop, prior to the fibers engaging with the cold roller, such that the fibers moving across the air flow in the removal loop toward the cold roller yields additional orientation of the fibers in the X vector direction;

b) superimposing the substantially single layer non-lofted veils and compressing the substantially single layer non-lofted veils together to produce interconnection of the layers along a Z vector;

c) cutting the interconnected layers into a plurality of R-Buds having a height of about 0.4 inches (10 mm) +/−0.3 inches (8 mm); and d) expanding and separating the R-Buds into discrete fibers, at the time of installation of the insulation, to form blown in insulation comprising a 3 dimensional random matrix of discrete fibers.

* * * * *